US006012580A

United States Patent [19]

Peters et al.

[11] Patent Number: 6,012,580

[45] Date of Patent: Jan. 11, 2000

[54] UNIVERSAL IMPLANT DISPENSER

[75] Inventors: Robert C. Peters; Robert C. Hackett, both of Tampa; David G. Phillips, Palm Harbor, all of Fla.

[73] Assignee: Linvatec Corporation, Largo, Fla.

[21] Appl. No.: 09/107,624

[22] Filed: Jun. 30, 1998

[51] Int. Cl.[7] ..... B65D 75/58

[52] U.S. Cl. ..... 206/470; 206/438

[58] Field of Search ..... 206/461–471, 206/438, 570; 220/4.23

[56] References Cited

U.S. PATENT DOCUMENTS

| | | | |
|---|---|---|---|
| 3,104,011 | 9/1963 | Bowman . | |
| 3,123,206 | 3/1964 | Gerber . | |
| 3,272,246 | 9/1966 | O'Farrell . | |
| 4,450,965 | 5/1984 | Paillet . | |
| 4,464,552 | 8/1984 | Pawlowski . | |
| 4,512,474 | 4/1985 | Harding | 206/470 |
| 4,771,934 | 9/1988 | Kalmanides | 206/470 |
| 4,872,551 | 10/1989 | Theros | 206/470 |
| 4,899,877 | 2/1990 | Kiernan | 206/470 |
| 5,069,261 | 12/1991 | Ji . | |
| 5,090,570 | 2/1992 | Todd | 206/470 |
| 5,385,113 | 1/1995 | Hellenbrand | 206/470 |
| 5,447,232 | 9/1995 | Chow | 206/470 |
| 5,472,281 | 12/1995 | Phelps . | |
| 5,842,567 | 12/1998 | Rowe et al. | 206/438 |

*Primary Examiner*—Jim Foster

*Attorney, Agent, or Firm*—Larson & Larson, P.A.; James E. Larson

[57] ABSTRACT

A universal dispenser for implants or other items includes a lightweight, thin housing made up of two clamshell halves pivoted together at a hinge. One of the halves has two laterally spaced recesses and the other of the halves has two laterally spaced projections configured to be frictionally retained within respective ones of the recesses when the halves are pivoted to a closed position. At least one of the clamshell halves has an elongated recess to form a chamber when the clamshell halves are pivoted to the closed position. The ends of the clamshell halves most remote from one another may include halves of an opening which is formed when the halves are pivoted to the closed position. This opening may be provided, if necessary or desired, so that an item such as an implant stored within the chamber formed by one or both elongated recesses may be removed therefrom when the clamshell halves are in the closed position merely by squeezing their edges together to expand the size of the opening and allow the item or implant to fall out of the opening. The size of the chamber formed by one or both of the elongated recesses is slightly smaller in its dimensions than the dimensions of the item or implant that is to be stored therein so that, when the item or implant is placed in the chamber and the clamshell halves are closed together to enclose the item or implant, a slight bowing of the clamshell halves occurs to frictionally retain it within the chamber.

17 Claims, 9 Drawing Sheets

UNIVERSAL IMPLANT DISPENSER

BACKGROUND OF THE INVENTION

The present invention relates to a universal dispenser for implants or other items. During the course of orthopedic surgery, the surgeon as well as nurses and other attendants are dressed in sterile body encapsulating clothing including the use of gloves. Gloves inherently reduce the tactile feel of the fingers and hands and prevent the wearer from manipulating objects and packages as easily as would be the case were the gloves not worn.

During the course of surgery, it is often necessary to remove instruments, implements and items to be surgically implanted from sterile packaging. Packaging that is currently known, for these purposes, is quite cumbersome and unwieldy and it is often difficult to easily remove items from packaging while wearing gloves during a surgical procedure.

As such, a need has developed for a simple, inexpensive packaging that may be used to safely and securely retain items such as, for example, those that will be implanted in the human body during surgery but which allows easy removal of such items from the packaging. The packaging should also allow storage and easy dispensing of other items. It is with these needs in mind that the present invention was developed.

The following prior art is known to Applicants:

U.S. Pat. No. 3,104,011 to Bowman discloses a package and display device that allows inspection of the contents thereof by applying slight pressure against the front and back surfaces of the package at the center and by pulling downwardly on a transparent envelope thereof while holding the supporting member by a portion adjacent an eyelet thereof. The present invention differs from the teachings of Bowman as contemplating a package closeable like a clamshell about an implant or other item and including an opening allowing removal of the implant or other item by squeezing the edges of the two clamshell halves toward one another, thereby eliminating frictional retaining forces on the item.

U.S. Pat. No. 3,123,206 to Gerber, U.S. Pat. No. 3,272,248 to O'Farrell, U.S. Pat. No. 5,069,261 to Ji, U.S. Pat. No. 5,472,281 to Phelps disclose packages designed to retain an item within and allowing access to the item by squeezing the side edges of the package. The present invention differs from the teachings of these patents as contemplating a package closeable like a clamshell about an item such as, for example, an implant and allowing access to the item by squeezing the side edges of the closed clamshell halves.

U.S. Pat. No. 4,464,552 to Pawlowski discloses a package including two halves closeable about an item that may be contained therein. Pawlowski uses pressure sensitive adhesive. The present invention differs from the teachings of Pawlowski as contemplating a package using tabs and recesses to hold the clamshell halves together and wherein one may access the contents by squeezing the side edges of the clamshell halves toward one another.

U.S. Pat. No. 4,450,965 to Paillet discloses a container for pharmaceutical ampules or the like wherein the ampules may be contained within two clamshell halves that may be pivoted to a closed position. Paillet fails to contemplate allowing access to the ampules by squeezing the side edges of the halves.

SUMMARY OF THE INVENTION

The present invention relates to a universal dispenser for implants or other items. The present invention includes the following interrelated objects, aspects and features:

(1) In a first aspect, the present invention includes a lightweight, thin housing made up of two clamshell halves pivoted together at a hinge.

(2) One of the halves has two laterally spaced recesses and the other of the halves has two laterally spaced projections sized and configured to be frictionally retained within respective ones of the recesses when the halves are pivoted to a closed position.

(3) At least one of the clamshell halves includes an elongated recess therein. If desired, both clamshell halves may include such recesses aligned with one another so that they, together, form a chamber within the clamshell halves when they are pivoted to the closed position.

(4) The ends of the clamshell halves most remote from one another may include halves of an opening which is formed when the halves are pivoted to the closed position. This opening is provided so that an item such as, for example, an implant stored within the chamber formed by one or both elongated recesses may be removed therefrom when the clamshell halves are in the closed position merely by squeezing their edges together to expand the size of the opening and allow the item or implant to fall out of the opening.

(5) In the preferred embodiment, the size of the chamber formed by one or both of the elongated recesses is slightly smaller in its dimensions than the dimensions of the item or implant that is to be stored therein. In this way, when the item or implant is placed in the chamber and the clamshell halves are closed together to enclose the item or implant, a slight bowing of the clamshell halves occurs although they are retained in the closed position by the recesses and their received projections. However, due to the slight bowing of the clamshell halves, the item or implant is better frictionally retained within the chamber without any movement therewithin and the bowing allows further bowing when the side walls of the clamshell halves are squeezed to allow enlargement of the opening and removal of the item or implant.

(6) In the preferred embodiment of the present invention, the inventive device is made of a suitable, thin, plastic material made either by injection molding, vacuum forming or in any other suitable process.

As such, it is a first object of the present invention to provide a universal dispenser for implants or other items.

It is a further object of the present invention to provide such a device including two clamshell halves pivoted together at a flexible hinge.

It is a yet further object of the present invention to provide such a device wherein the clamshell halves may be pivoted together to enclose an item or implant contained within a chamber formed between the halves.

It is a still further object of the present invention to provide such a device wherein the item or implant may be removed from the chamber by squeezing the side edges of the halves.

It is a still further object of the present invention to provide such a device wherein the chamber formed by the halves is smaller than the item or implant to be stored therein whereby a slight bowing of the halves is caused by the item captured between the halves when they are fixed in a closed position.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
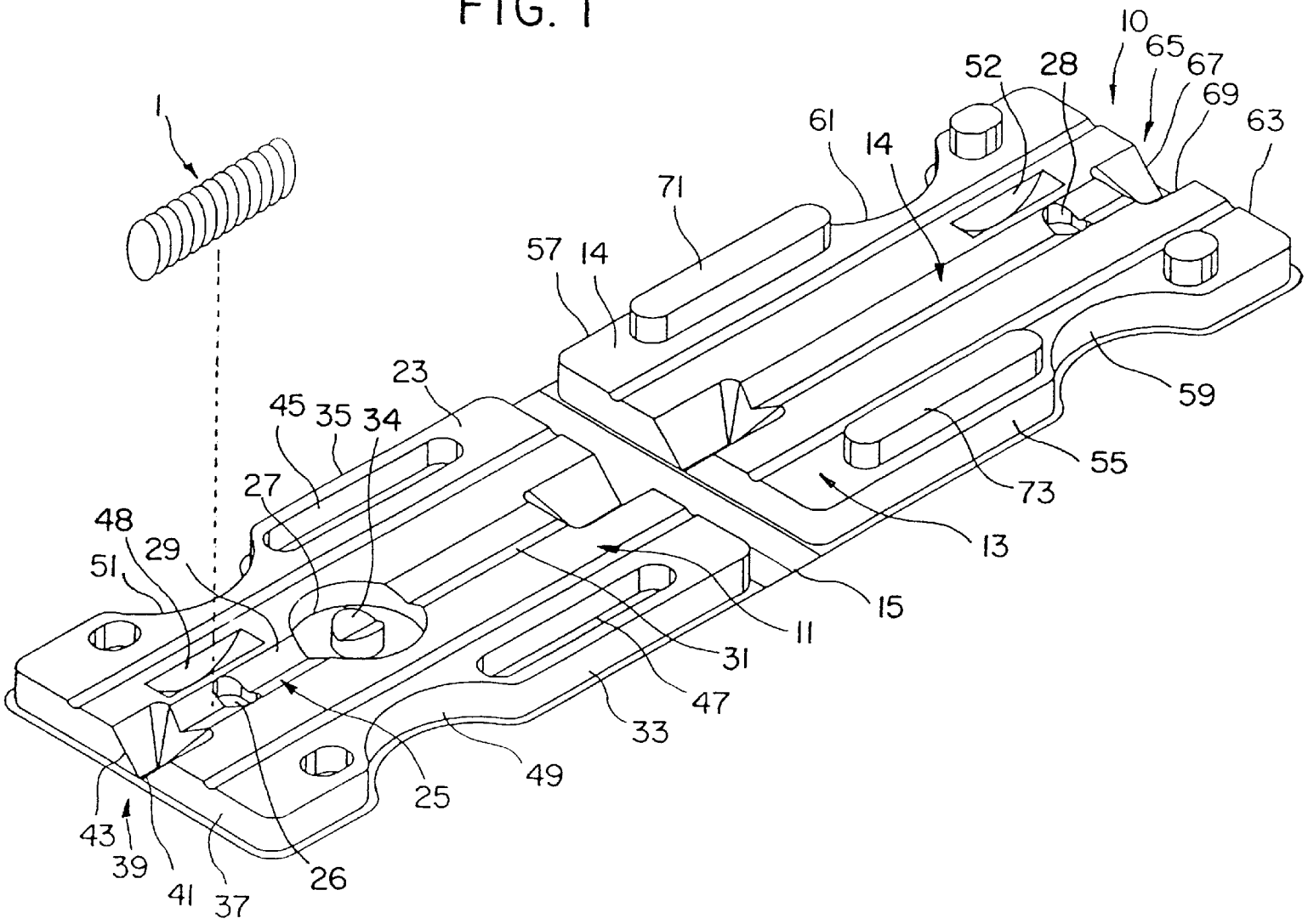
FIG. 1 shows a perspective view of a preferred embodiment of the present invention with the halves thereof in the open position.
Figure 5:
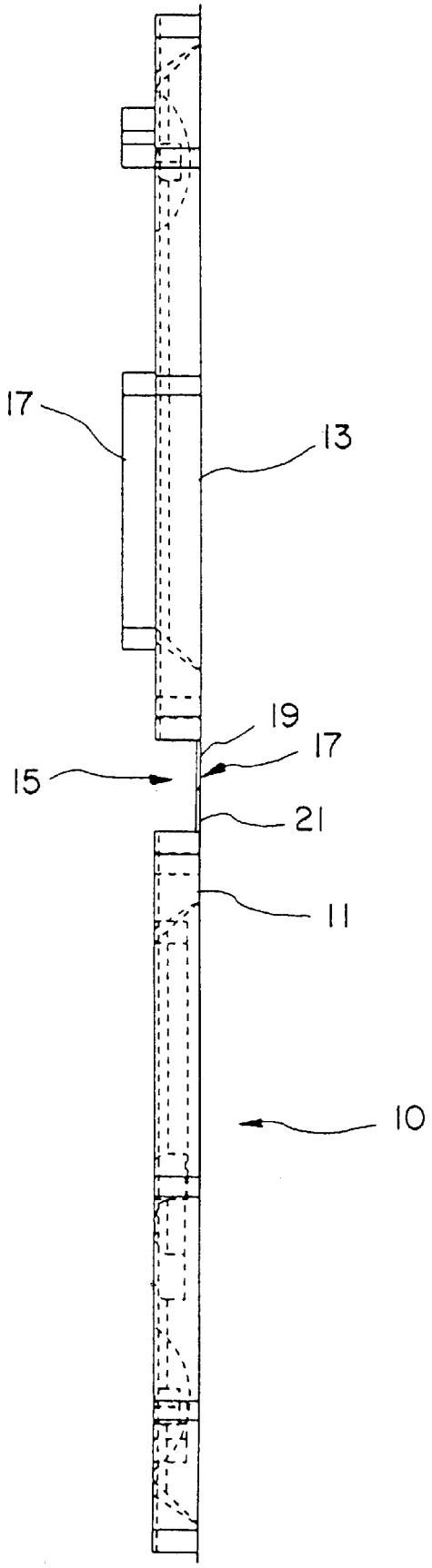
FIG. 5 shows a side view of the clamshell halves in the open position shown in FIG. 1.

With reference, first, to FIG. 1, the present invention is generally designated by the reference numeral 10 and is seen to include a first clamshell half 11 and a second clamshell half 13 pivoted together at a hinge 15. The hinge 15 is better seen with reference to FIG. 5 and includes a thickened area 17 and two thin areas 19 and 21 that directly connect to the respective halves 13 and 11.

The clamshell half 11 includes an inner surface 23 in which an elongated recess 25 is formed that includes a circular recess 27, two thinner sections 29 and 31, and a further recess portion 26 in the section 29. The half 11 includes side edges 33 and 35 and a forward edge 37 having a recess 39 therein including triangular walls 41, 43. The half 11 also includes two laterally spaced recesses 45 and 47 and a further recess 48 for purposes to be described in greater detail hereinafter. The side edges 33, 35 also have relieved portions 49 and 51, respectively, for a purpose to be described in greater detail hereinafter.

The clamshell half 13 includes side edges 55 and 57 having respective relieved portions 59 and 61, an end edge 63 having a central recess 65 therein including a triangular configuration with side walls 67 and 69 and a recess 14 aligned with the recess 25 and having a recess portion 28 aligned with the recess portion 26. The half 13 also includes two laterally spaced protrusions 71 and 73 and a further recess 52 for purposes to be described in greater detail hereinafter.

FIG. 1 also shows a device designated by the reference numeral 1 and which comprises an example of an item or implant that may be stored for later dispensing from the inventive package 10. The item or implant 1 is exemplary and for the purposes of the subsequent discussion, will be described as a surgically implantable headless screw 1.

Figure 2:
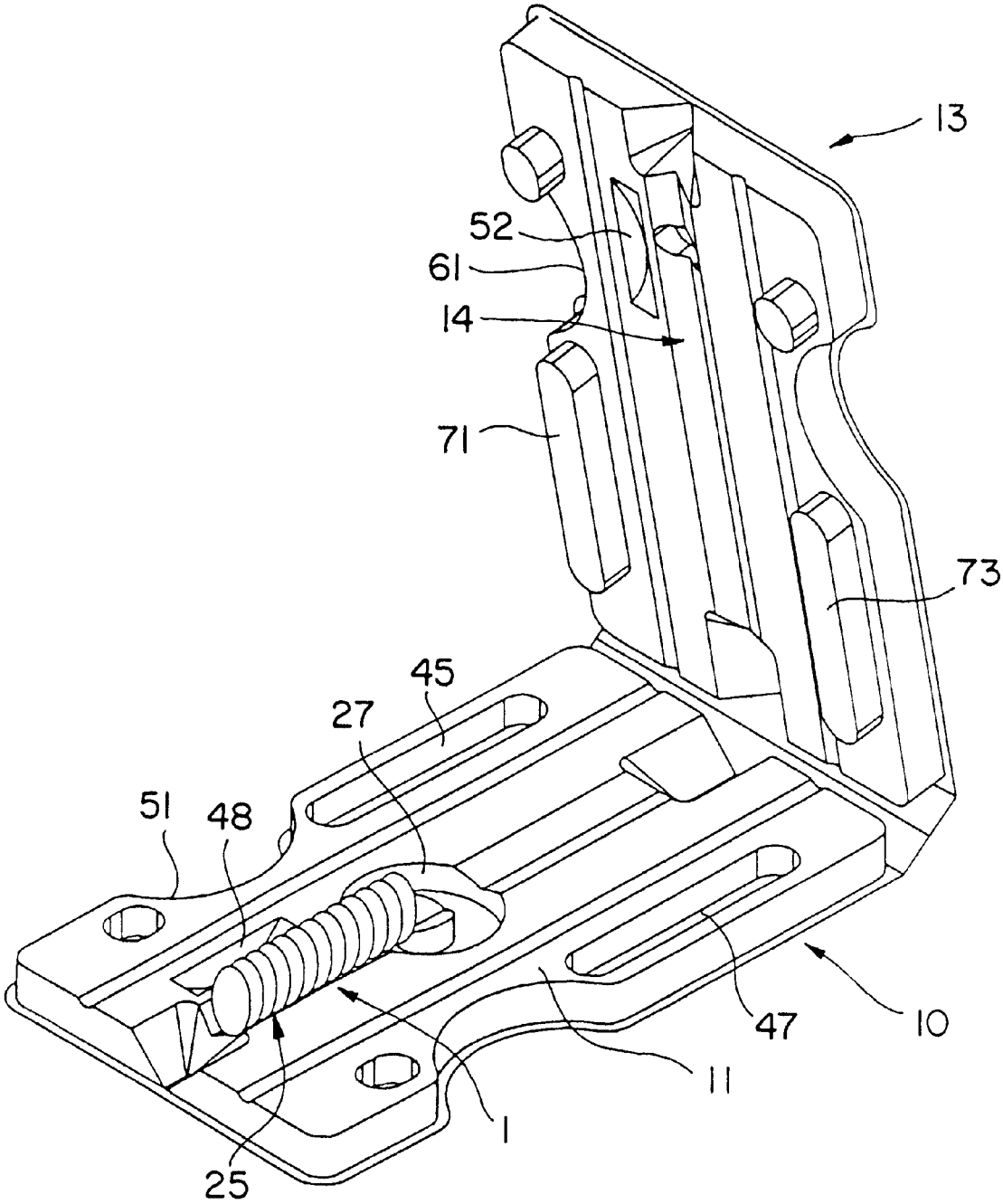
FIG. 2 shows a perspective view showing an item or implant received within a chamber half in one of the clamshell halves and with the other half being pivoted toward a closed position.
Figure 3:
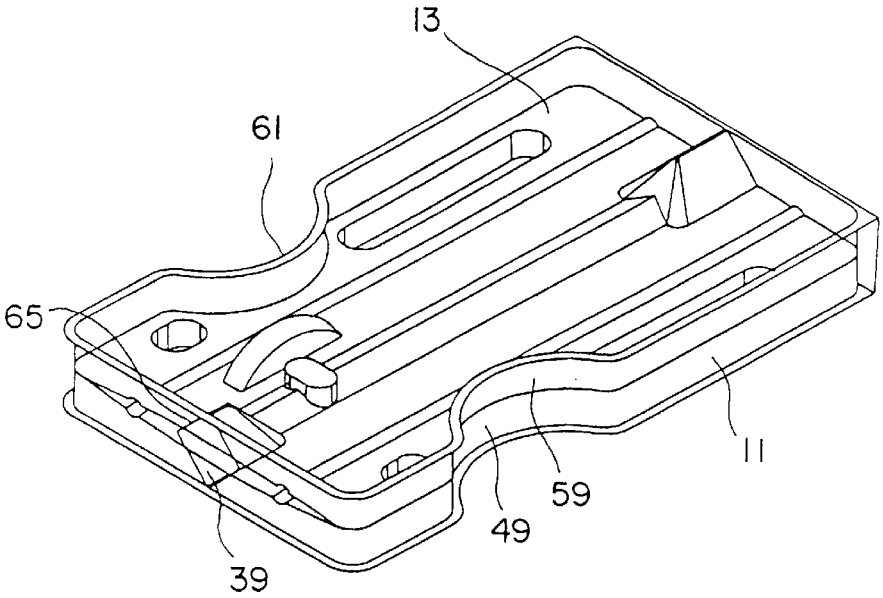
FIG. 3 shows a perspective view of the clamshell halves in a closed position.
Figure 4:
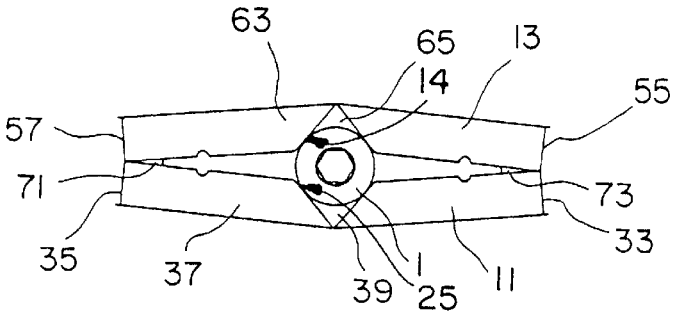
FIG. 4 shows a front view of the configuration of FIG. 3 with an item captured between the halves.

As seen in FIG. 2, the screw 1 may be received within the recess portion 29 of the recess 25 so that when the half 13 is pivoted over the half 11, the screw 1 is captured within the chamber formed by the recess portion 25 and the recess 14 of the half 13. With further reference to FIGS. 2, 3 and 4, when the half 13 is pivoted over the half 11, the protrusions 73, 71 enter the respective recesses 47 and 45 and are frictionally retained therein to hold the package 10 in the configuration shown in particular in FIGS. 3 and 4.

As seen in particular in FIGS. 3 and 4, the recesses 39 and 65 combine together to form an opening through which the screw 1 may be dispensed. As particularly seen in FIG. 4, the sizes of the elongated recesses 14 and 25 are specifically intended to be smaller than the dimensions of the screw 1 so that when the halves 13 and 11 are pivoted to the position shown in FIG. 4, the inherent flexibility of the halves 11 and 13 allows them to bow outwardly to (1) provide frictional retention of the screw 1, and (2) allow further bowing of the halves 13 and 11 when their side edges are squeezed.

Figure 6:
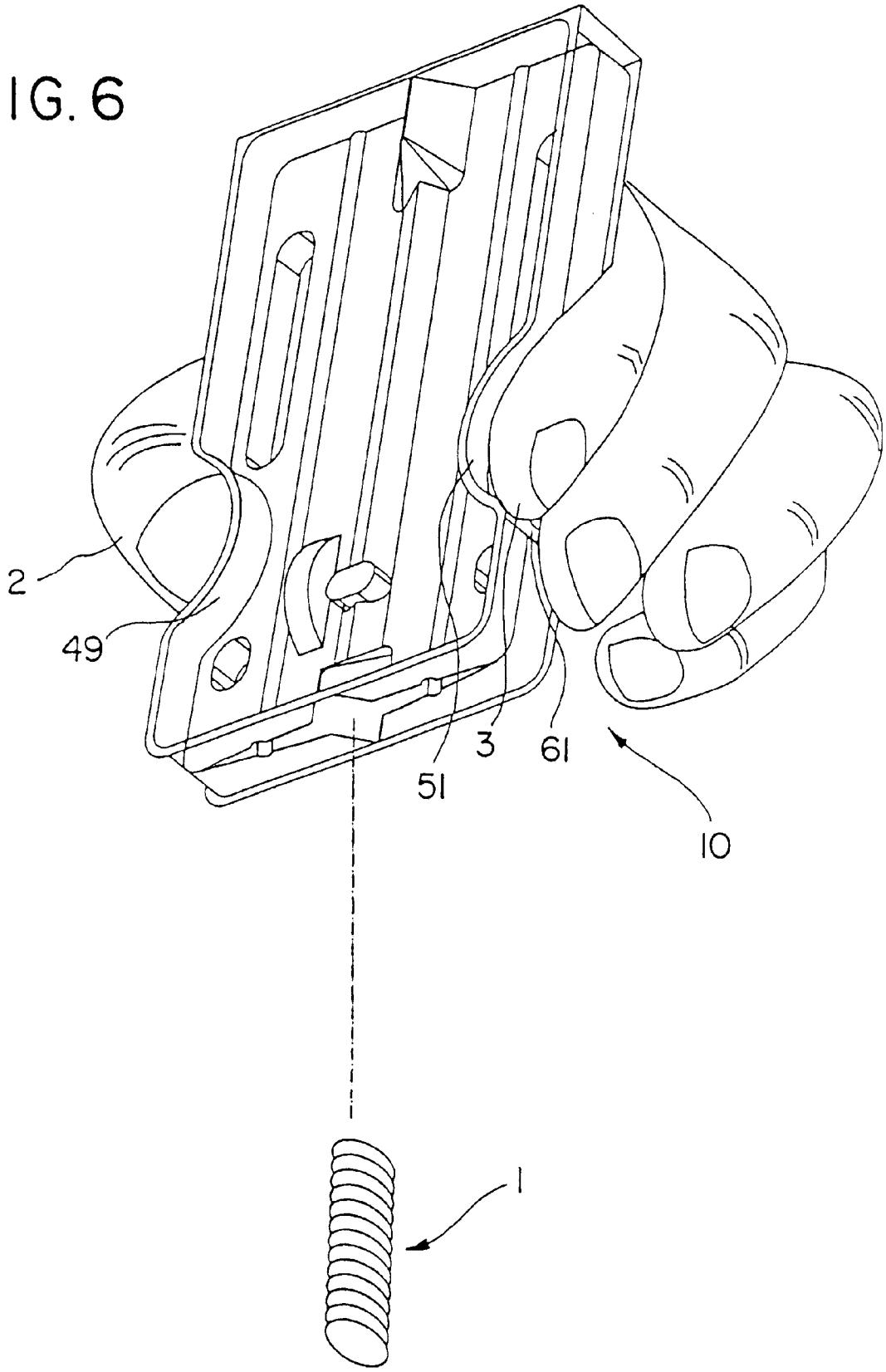
FIG. 6 shows a perspective view of the device in the closed position shown in FIGS. 3 and 4 but with the hand of a user squeezing the side edges of the clamshell halves to allow removal of the item or implant.

As should be understood from FIGS. 2 and 3, in particular, the relieved portions 49 and 59 form a first finger receiving portion while the relieved portions 61 and 51 form a second oppositely disposed finger receiving portion. When it is desired to dispense the screw 1, with reference to FIG. 6, the thumb 2 and forefinger 3 of the user are placed on opposed recesses formed by the respective relieved portions 49, 59 and 51, 61 and the package 10 is squeezed from that location causing further bowing (as should be understood from FIG. 4) to widen the opening formed by the recesses 39, 65 so that the opening is large enough to allow the screw 1 to be controllably dropped out of the package 10 onto a sterile surface.

In the preferred embodiment of the present invention, as illustrated in the drawing figures, each of the clamshell halves 11, 13 may be provided with a recess portion 25, 14, respectively, that, when combined together, form a chamber therebetween. This chamber may be designed of any size, shape or configuration depending upon the item or items to be stored therein. If desired, the chamber may be formed of a recess in one of the halves only. The only requirement is that the chamber is so sized and configured that the item or items stored therein may be removed from the package without pivoting the clamshell halves away from each other. Rather, such removal must take place by virtue of squeezing of the lateral edges of the clamshell halves as locked together in the manner illustrated in FIGS. 3, 4 and 6 so that an opening may be formed at the extreme ends of the clamshell halves to permit such removal.

Figure 7:
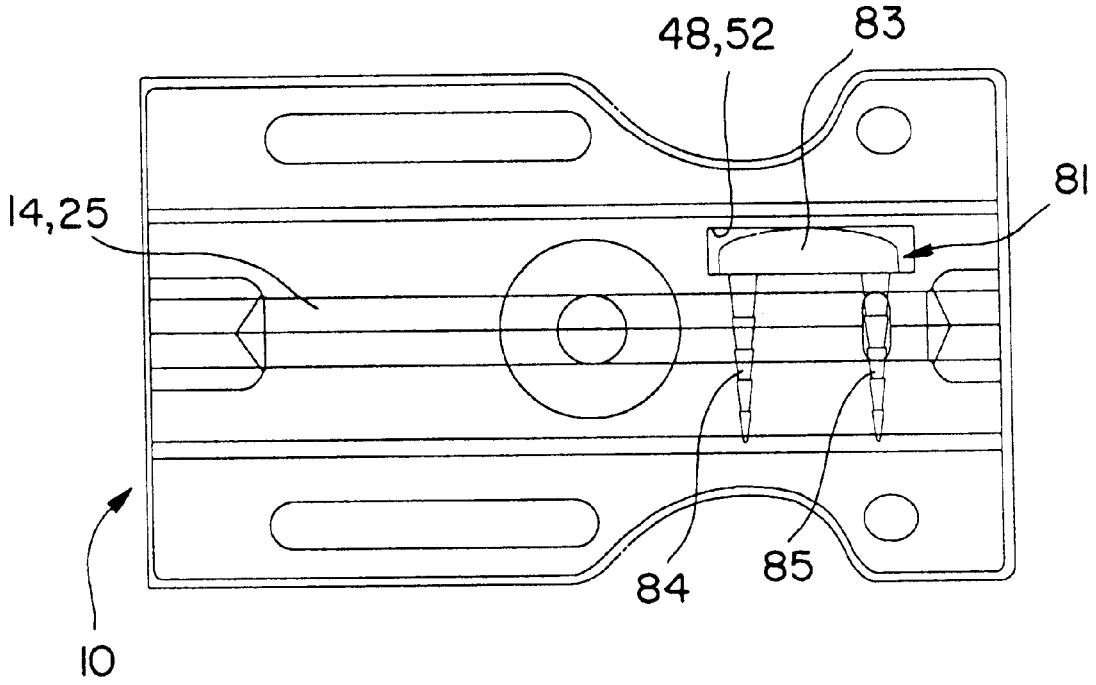
FIGS. 7–13 show top views of the device with each figure showing a particular item held between the halves.
Figure 8:
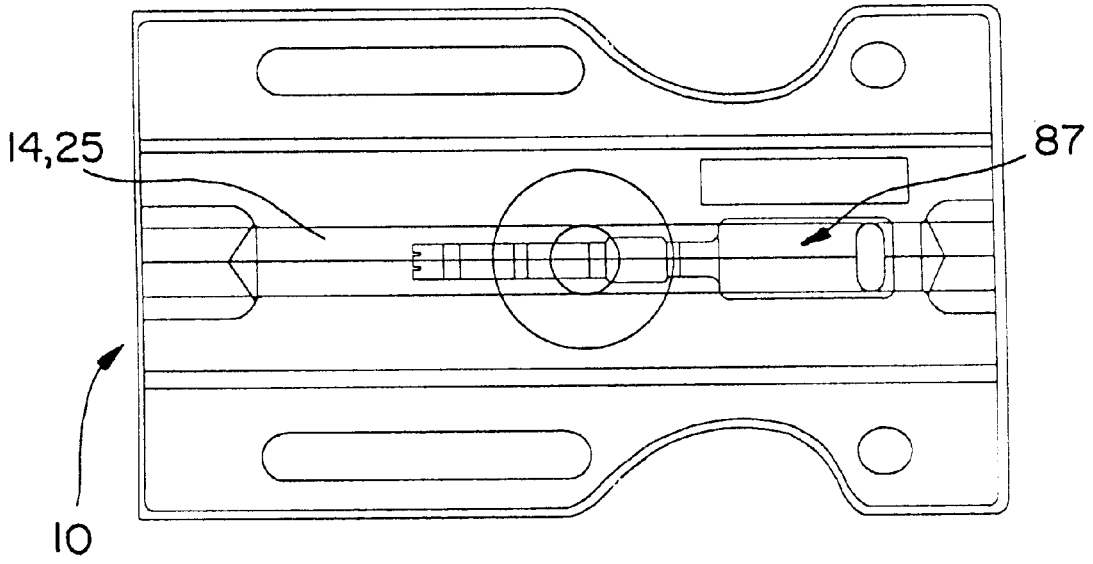
Figure 9:
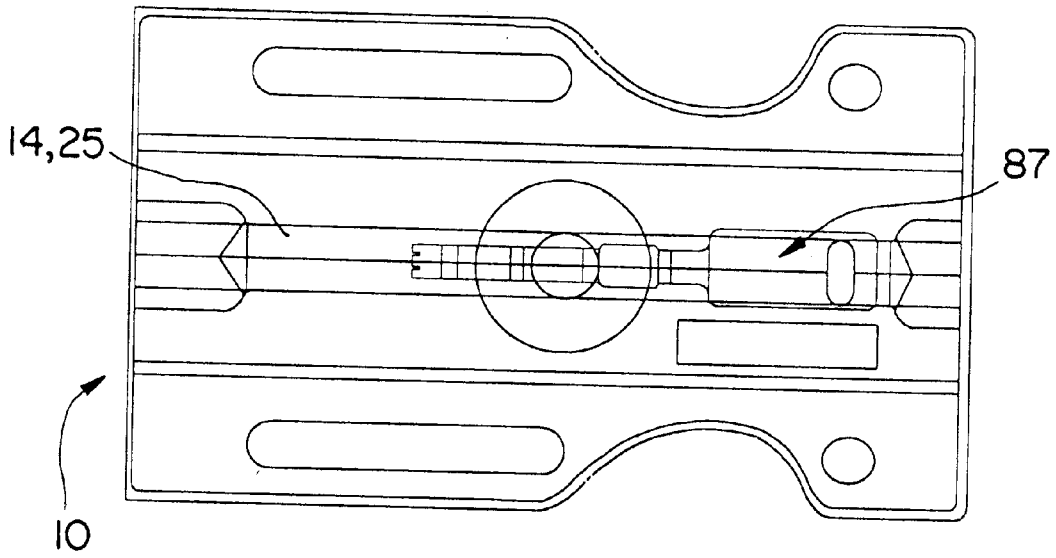

FIGS. 7–13 show top views of the device 10 with each figure showing a particular item held between the halves 11 and 13. FIG. 7 shows the dispenser 10 retaining a surgical staple 81 having a head 83 received within the recesses 48, 52 and with legs 84 and 85 extending perpendicularly across the recesses 25 and 14. FIGS. 8 and 9 show an abrading burr 87 retained within the recesses 14 and 25.

Figure 10:
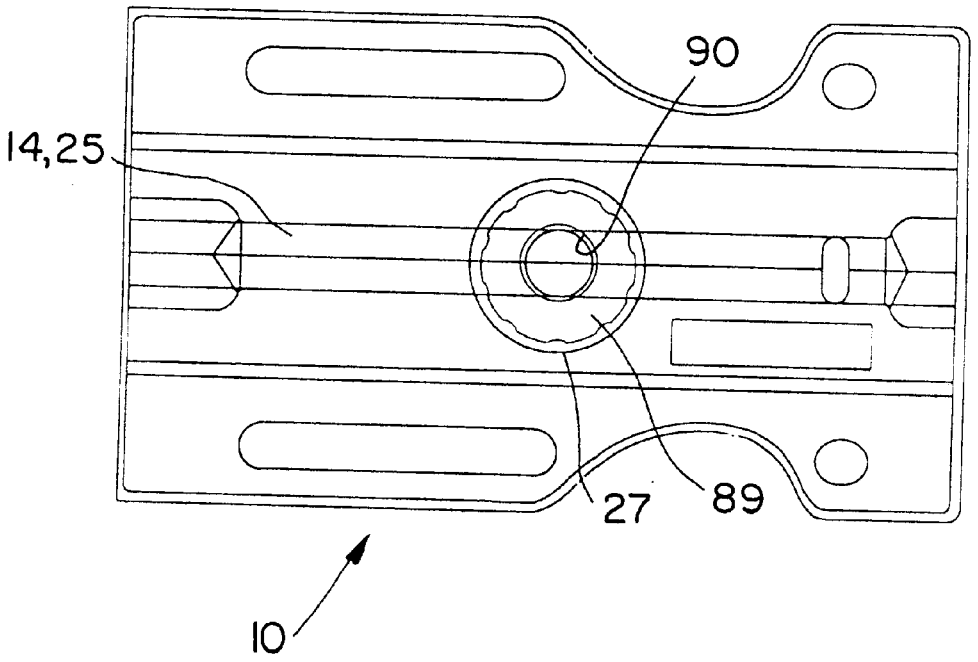

FIG. 10 shows a washer 89 received within the recess 27, which recess is also seen in FIGS. 1 and 2. As best seen in FIG. 1, the circular recess 27 includes a centrally located hub 34 that receives a central opening 90 of the washer 89.

Figure 11:
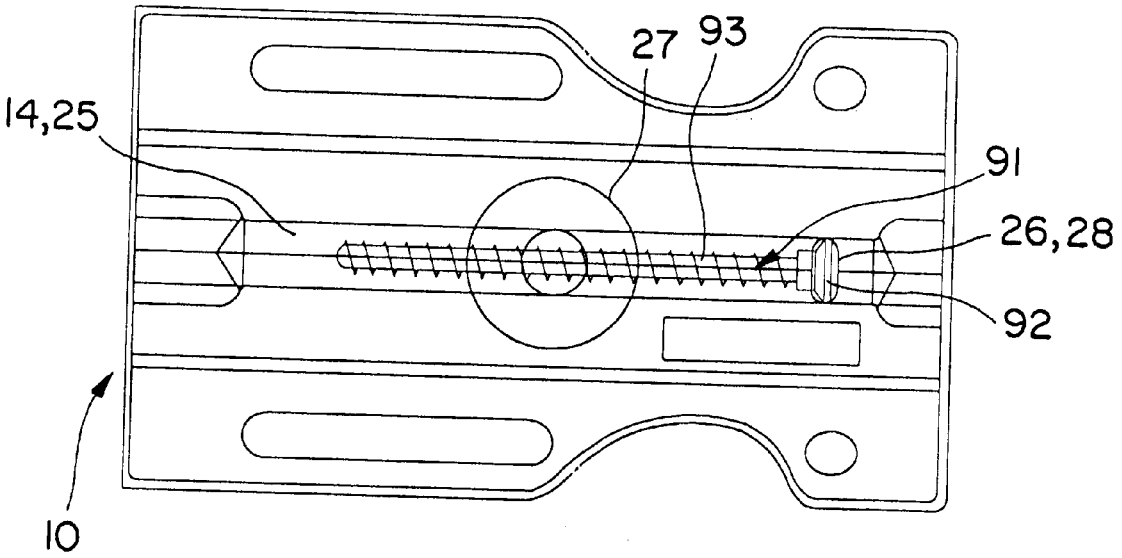

FIG. 11 shows a bone screw 91 having a head 92 received within the chamber formed by the recesses 26, 28 and an elongated threaded body 93 received within the chamber formed by the recesses 14, 25.

Figure 12:
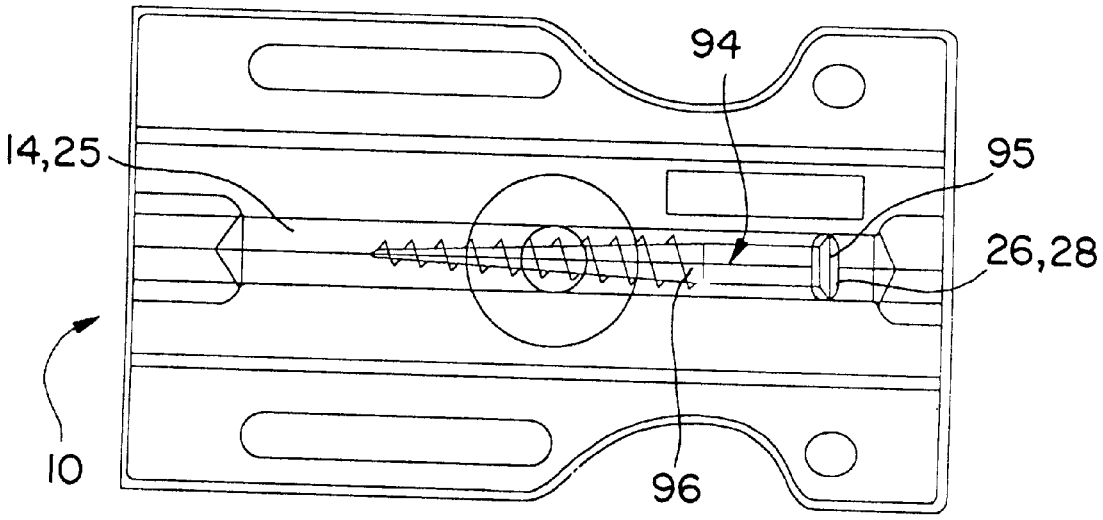

FIG. 12 shows a different bone screw 94 having a head 95 received within the chamber formed by the recesses 26, 28 and an elongated threaded body received within the chamber formed by the recesses 14, 25.

Figure 13:
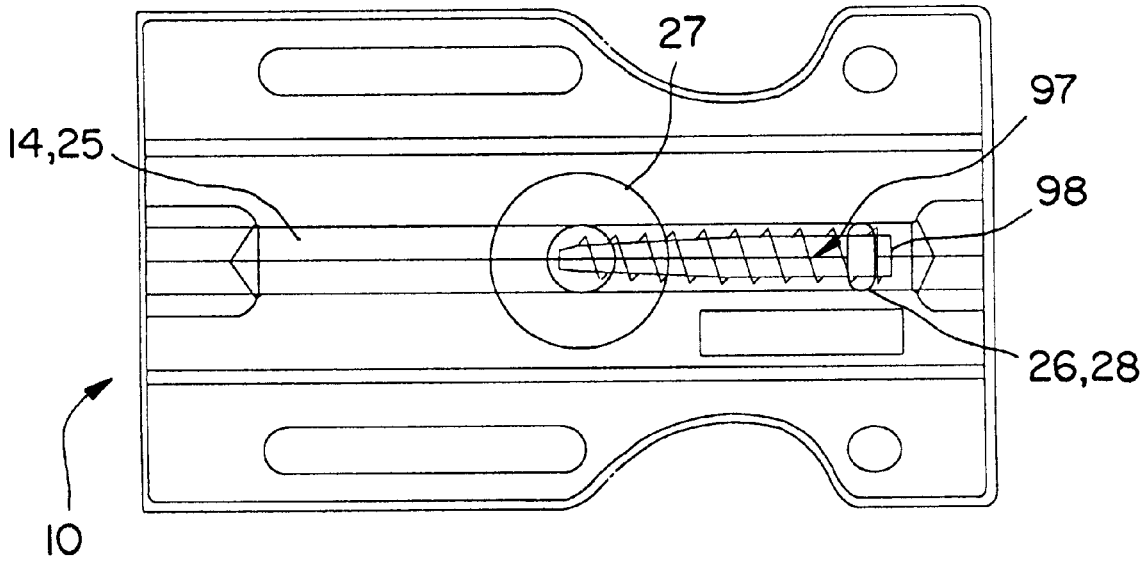

FIG. 13 shows a cannulated headless bone (interference) screw 97 received within the chamber formed by the recesses 14, 25 and with the proximal end 98 thereof located adjacent the chamber formed by the recesses 26, 28.

Concerning each of the items described in FIGS. 7–13, each of these items may be removed from the dispenser 10 in the same manner described with regard to FIGS. 1–6 by squeezing the side edges of the dispenser to enlarge the opening 39, 65 and permit the item to be controllably dropped onto a sterile surface.

In the preferred embodiment of the present invention, the inventive device is formed of a thin, flexible, plastic material that is sterilizable and that may be formed by any suitable method such as, for example, injection molding, pressure molding, vacuum forming and the like.

As such, an invention has been disclosed in terms of a preferred embodiment thereof that fulfills each and every one of the objects of the invention as set forth hereinabove and provides a new and useful universal dispenser for implants or other items of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

We claim:

1. A package for storing and dispensing an item, comprising:

a) a body having first and second clamshell halves pivoted together at a flexible hinge, each of said halves having opposed side edges with finger receiving relieved portions therein and end edges adjacent one another in a closed position of said package;

b) said first half having a first recess therein adapted to receive an item and a second recess laterally spaced from said first recess;

c) said second half having a protrusion;

d) said halves being pivotable together from an open position to said closed position to enclose an item in said first recess, said second recess frictionally receiving said protrusion to retain said halves in said closed position;

e) whereby in said closed position, said side edges may be squeezed to bow said halves apart, thereby separating said end edges and allowing removal of said item from said first recess.

2. The package of claim 1, wherein said second recess comprises two recesses laterally spaced to either side of said first recess and said protrusion comprises two protrusions, each located to be frictionally received in one of said laterally spaced protrusions.

3. The package of claim 1, wherein said first recess is sized slightly smaller than said item whereby, in said closed position, said halves bow apart to create a restoring force frictionally acting on said item to prevent said item from moving.

4. The package of claim 1, further including third and fourth recesses formed in respective ones of said end edges and aligned with said first recess to form an access opening thereto.

5. The package of claim 4, wherein said opening is diamond-shaped.

6. The package of claim 1, wherein said halves and hinge are integrally molded.

7. The package of claim 6, made of plastic.

8. The package of claim 4, further including a fifth recess in said second half aligned with said first recess in said closed position to form a chamber.

9. A package for storing and dispensing an item, comprising:

a) a plastic molded body having first and second clamshell halves pivoted together at a flexible hinge, each of said halves having opposed side edges with finger receiving relieved portions therein;

b) said first half having a first recess therein adapted to receive an item and second recesses laterally spaced to either side of said first recess;

c) said second half having a protrusion for each second recess;

d) said halves being pivotable together from an open position to a closed position to enclose an item in said first recess, said second recesses frictionally receiving said protrusions to retain said halves in said closed position;

e) whereby in said closed position, said side edge recesses may be squeezed to bow said halves apart, thereby creating an access opening to said first recess and allowing removal of said item from said first recess.

10. The package of claim 9, wherein said first recess is sized slightly smaller than said item whereby, in said closed position, said halves bow apart to create a restoring force frictionally acting on said item to prevent said item from moving.

11. The package of claim 9, wherein said halves and hinge are integrally molded.

12. The package of claim 9, further including a third recess in said second half aligned with said first recess in said closed position to form a chamber.

13. A package for storing and dispensing an item, comprising:

a) a body having first and second halves, each of said halves having opposed side edges with finger receiving relieved portions therein;

b) said first half having a first recess therein adapted to receive an item and a second recess laterally spaced from said first recess;

c) said second half having a protrusion;

d) said halves being attachable together in a closed position to enclose an item in said first recess, said second recess frictionally receiving said protrusion to retain said halves in said closed position;

e) whereby in said closed position, said side edges may be squeezed to bow said halves apart, thereby creating an access opening to said first recess and allowing removal of said item from said first recess.

14. The package of claim 13, wherein said second recess comprises two recesses laterally spaced to either side of said first recess and said protrusion comprises two protrusions, each located to be frictionally received in one of said laterally spaced protrusions.

15. The package of claim 13, wherein said first recess is sized slightly smaller than said item whereby, in said closed position, said halves bow apart to create a restoring force frictionally acting on said item to prevent said item from moving.

16. The package of claim 13, wherein said access opening is diamond-shaped.

17. The package of claim 13, made of plastic.

* * * * *